US007758111B2

(12) United States Patent
Chen

(10) Patent No.: US 7,758,111 B2
(45) Date of Patent: Jul. 20, 2010

(54) FOLDABLE CHAIR WITH A BACKREST UNIT

(76) Inventor: Te-Lung Chen, No. 248, Yiling Rd., Render Shiang, Tainan County (TW) 717

( * ) Notice: Subject to any disclaimer, the term of this patent is extended or adjusted under 35 U.S.C. 154(b) by 0 days.

(21) Appl. No.: 12/214,838

(22) Filed: Jun. 24, 2008

(65) Prior Publication Data

US 2009/0315366 A1 Dec. 24, 2009

(51) Int. Cl.
*A47C 4/00* (2006.01)
*A47C 4/28* (2006.01)

(52) U.S. Cl. ..... 297/16.2; 297/16.1; 297/42; 297/45

(58) Field of Classification Search ..... 297/45, 297/42, 16.1, 16.2
See application file for complete search history.

(56) References Cited

U.S. PATENT DOCUMENTS 6,082,813 A * 7/2000 Chen ..... 297/16.2
6,231,119 B1 * 5/2001 Zheng ..... 297/16.2
6,540,290 B2 * 4/2003 Liu ..... 297/45
6,629,722 B1 * 10/2003 Tang ..... 297/45
6,776,433 B2 * 8/2004 Harrison et al. ..... 280/647
6,899,383 B2 * 5/2005 Hwang ..... 297/16.2
2003/0025362 A1 * 2/2003 Liu ..... 297/45

* cited by examiner

*Primary Examiner*—David Dunn
*Assistant Examiner*—Erika Garrett

(57) ABSTRACT

A foldable chair with a supporting backrest unit includes a pair of front legs, a pair of rear legs, a plurality of interconnected frames, a pair of armrest rods, a backrest rod and a seat unit (30). Each of rear leg rods is installed with a round protrusion and the interconnected frames are pivotally joined between each leg rods. Each armrest rod is engaged between the front and rear leg rods so as to enforce the supporting strength of entire structure. The seat unit comprises a seat fabric and a backrest fabric. Further, the backrest unit includes two sleeves and a backrest rod, wherein the first sleeve is engaged through one rear leg rod while the second sleeve is installed on another end of the backrest rod to engage through another rear leg rod.

4 Claims, 13 Drawing Sheets

FOLDABLE CHAIR WITH A BACKREST UNIT

BACKGROUND OF THE PRESENT INVENTION

1. Field of the Invention

The present invention relates to a foldable chair, particularly with a backrest unit which could strengthen the supporting force of the rear leg rods.

2. Description of the Related Arts

As shown in FIGS. 10, 10-1, 11, 11-1, the second conventional foldable chair is shown to comprise a pair of individual rear leg rods without any supporting structure. When someone sits on the seat unit, the stress that a pair of front and rear leg rods suffer could be distracted by the armrest rods, however, when leaning on the backrest unit, the stress that a pair of rear leg rods suffer could not be distracted, since there are no supporting structure there between which would cause the structure damaged and the safety concern issue after constantly suffering from seating stress.

SUMMARY OF THE PRESENT INVENTION

Please refer to FIGS. 1, 2, 2-1, 3, 3-1 and 4, the inventors has improved the design in view of the shortcomings of the prior art. The present invention is to provide a foldable chair with a backrest unit as a supporting structure. Accordingly, a foldable chair of the present invention comprises a pair of front leg rods, rear leg rods, a plurality of interconnected frames, two armrest rods, a seat unit, a backrest unit and a backrest rod including two sleeves and a backrest rod that are pivoted to a rear leg rod via the first sleeve. The advantages are as following:

Firstly, a backrest rod unit of the present invention could enforce the supporting force of the rear leg rods and prevent them from being deformed by the inwardly stress of the backrest unit which could make the whole structure more stabilized.

Secondly, the pivot sleeve of the present invention which is installed on the first rear leg rod is pivotally connected with the backrest rod, and the sleeve is secured to the second rear leg rod. During folding, the backrest rod is folded by removing the sleeve without interrupting the folding process.

BRIEF DESCRIPTION OF THE DRAWINGS

FIG. 2-1 is a perspective view of the foldable chair frame structure in folding position according to the present invention.

FIG. 3-1 is the second perspective view illustrating the action of folding a backrest rod of the preferred embodiment according to the present invention.

FIG. 6-1 is a perspective view of the third arrangement method of a foldable chair according to the present invention.

FIG. 7-1 is a perspective view of the fourth arrangement method of a foldable chair according to the present invention.

FIG. 9-1 is perspective view of the fifth arrangement method of a foldable chair in folding position according to the present invention.

FIG. 10-1 is a perspective view of the frame structure of a foldable chair in folding position of the second conventional invention.

FIG. 11-1 is the second perspective view illustrating the direction of stress of the foldable chair of the second conventional invention.

FIG. 12-1 is a perspective view of the foldable chair in folded position of the third conventional invention.

DETAILED DESCRIPTION OF THE PRESENT INVENTION

Figure 1:
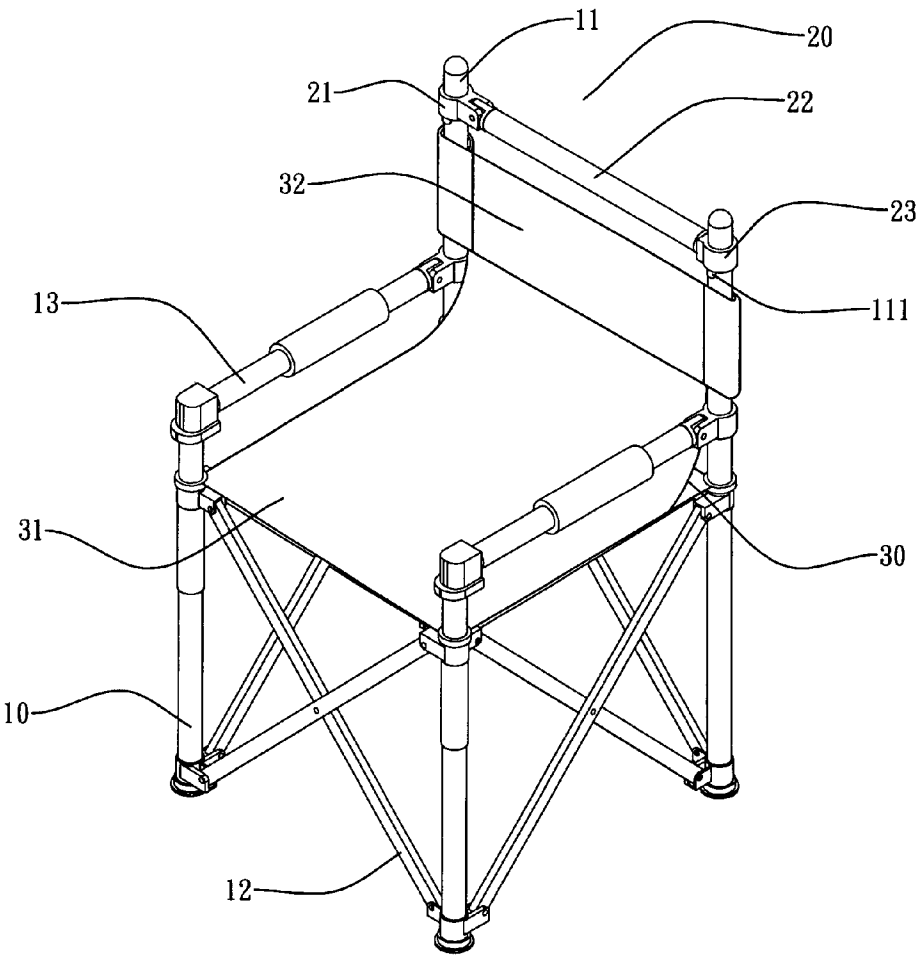
FIG. 1 is a perspective view of the present invention.

Please refer to FIGS. 1 through 4, the preferred embodiment of the foldable chair includes a pair of front legs (10), a pair of rear leg rods (11), a plurality of interconnected frames (12), a pair of armrest rods (13), a backrest unit (20) and a seat unit (30).

Each of the rear leg rods (11) is respectively installed with a round protrusion (111) protruding from any position thereof for fastening the backrest unit (20) and retaining the height of installation. The interconnected frames (12) pivotally crisscross each other between the front and rear leg rods (10, 11) respectively in extended position. The armrest rods (13) are positioned between the front and rear leg rods (10, 11) for supporting the whole frame structure.

Figures 1, 2:
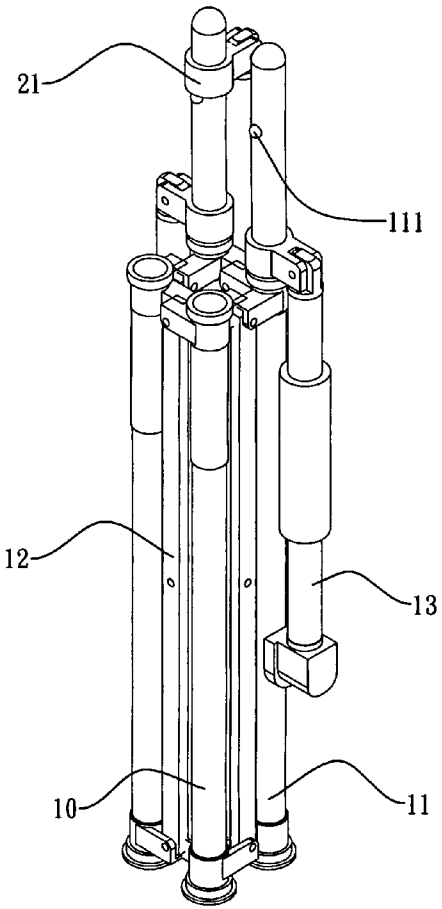
FIG. 2 is a perspective view of the frame structure of the preferred embodiment of the foldable chair according to the present invention.
Figure 2:
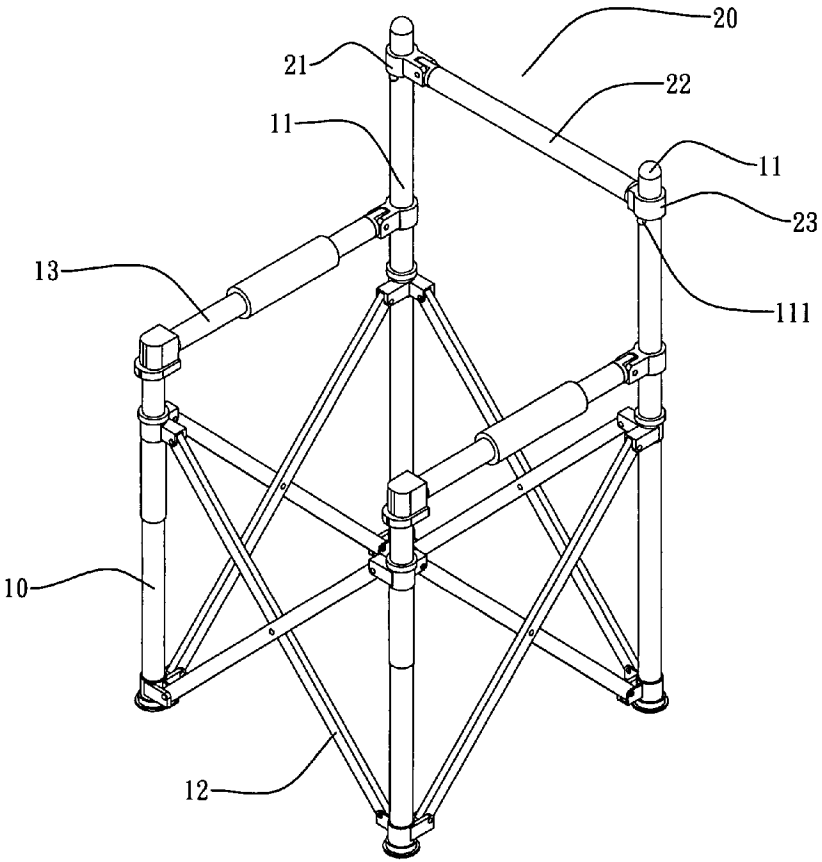
Figure 4:
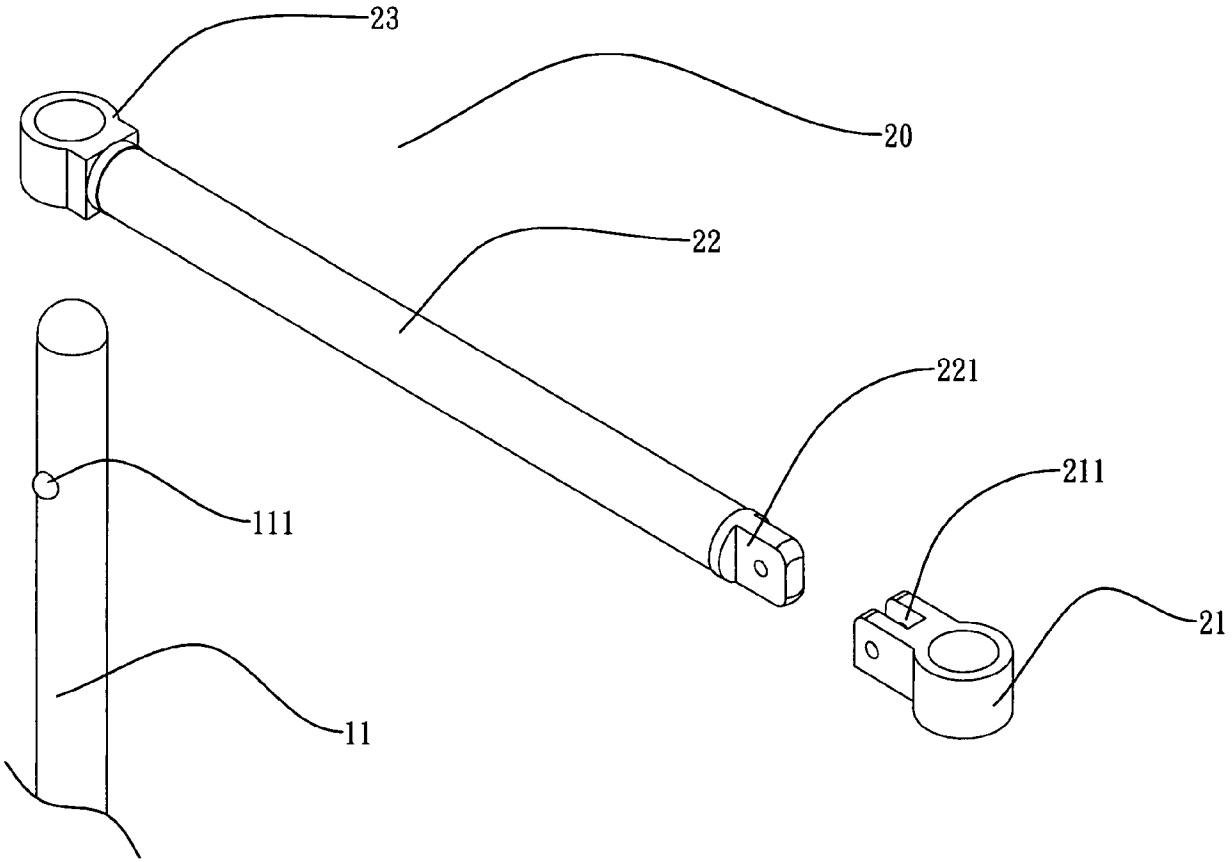
FIG. 4 is an exploded perspective view of the backrest unit of the preferred embodiment according to the present invention.

Please refer to FIG. 4, the backrest unit (20) is formed with a first sleeve (21) disposed at one rear leg rod (11) having a receiving slot (211) positioned thereon. A protrusion plate (221) is positioned at one end of the backrest rod (22) for engaging with the receiving slot (211) forming a pivot joint. A second sleeve (23) is installed at another end of the backrest rod (22) and engaging through the rear leg rod (11) for retaining the backrest rod (22) on any random position thereof. As shown in FIG. 2, the first sleeve (21) is positioned on one of the rear leg rods (11) leaning against the round protrusion (111) when the chair frame is disposed at extended position; while the second sleeve (23) is engaged with another rear leg rod (11) and leaning against the round protrusion (111) so as to retain the backrest rod (22) positioned there between to enforce the supporting structure.

Figures 1, 3:
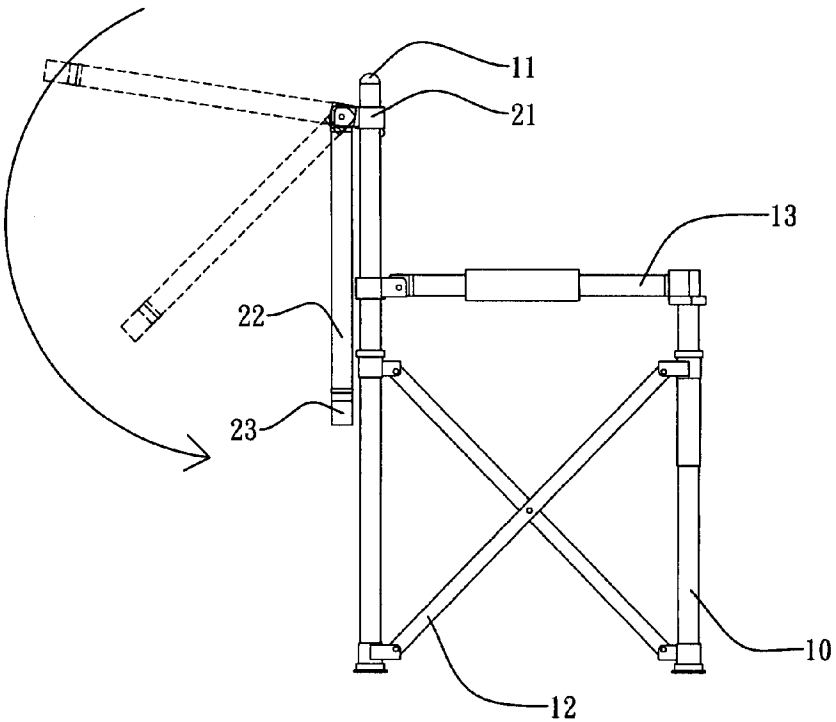
FIG. 3 is the first perspective view illustrating the action of folding a backrest unit of the preferred embodiment according to the present invention.
Figure 3:
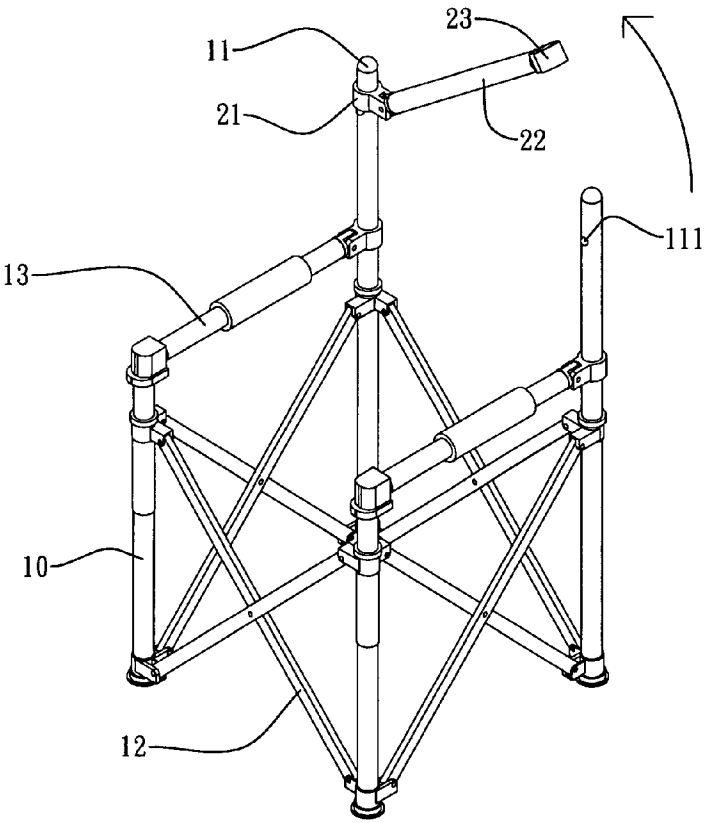

As shown in FIGS. 3, 3-1, folding of the preferred embodiment can be conducted by removing the second sleeve (23) from the rear leg rod (11) and rotating the backrest rod (22) backward against the first sleeve (21) and push the backrest rod (22) downward leaning against the rear leg rod (11). Therefore, the interruption of the backrest rod (22) is avoided during the folding process.

The seat unit (30) engaging with the front and the rear leg rods respectively comprises a seat fabric (31) and a backrest fabric (32)

Figure 5:
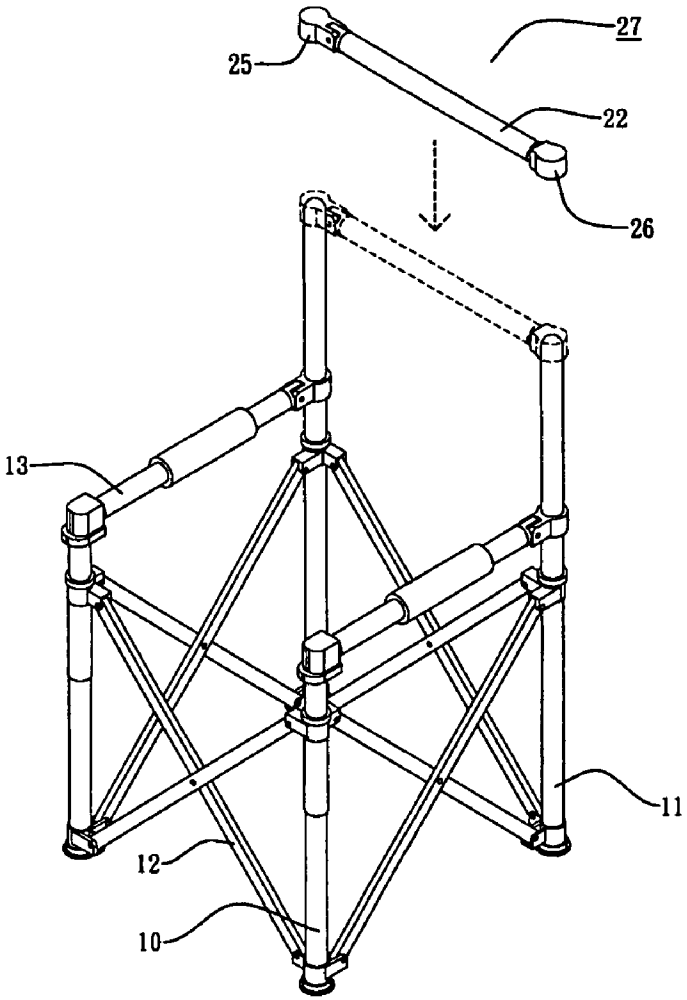
FIG. 5 is a perspective view of the first arrangement method of a foldable chair according to the present invention.

Please refer to FIG. 5, the first arrangement methods of the preferred embodiment, two ends of the backrest unit (20) as shown in FIG. 4 are respectively replaced with a first and second rod caps (25, 26) so as to cover the top of the rear leg rods (11) forming a double-cap backrest rod (27).

Figures 1, 6:
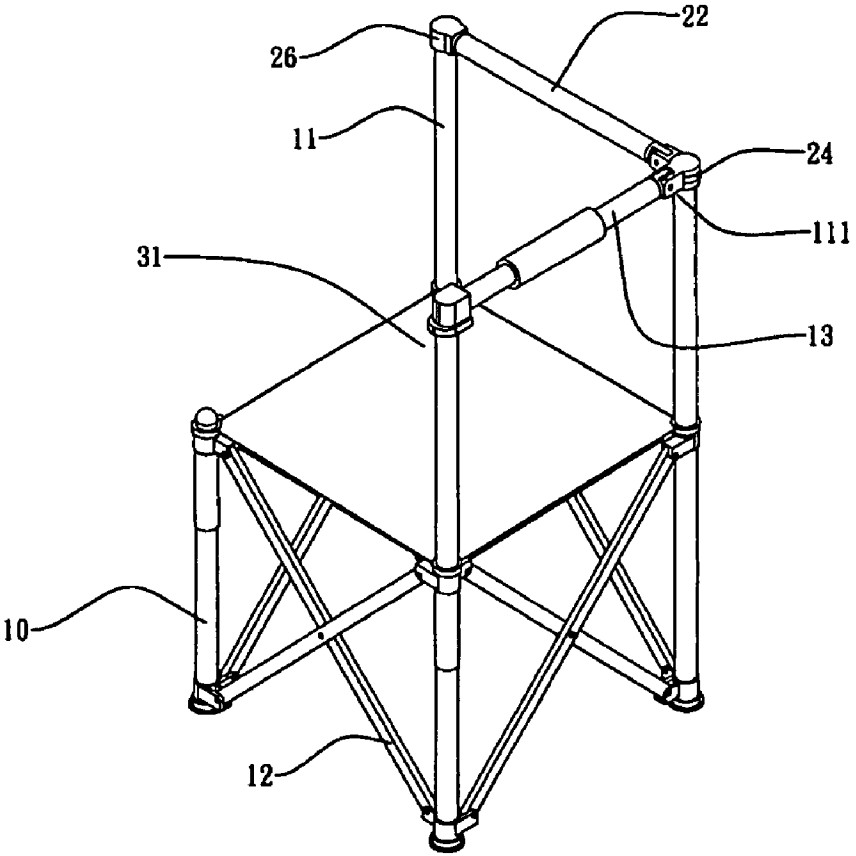
FIG. 6 is a perspective view of the second arrangement method of a foldable chair according to the present invention.
Figure 6:
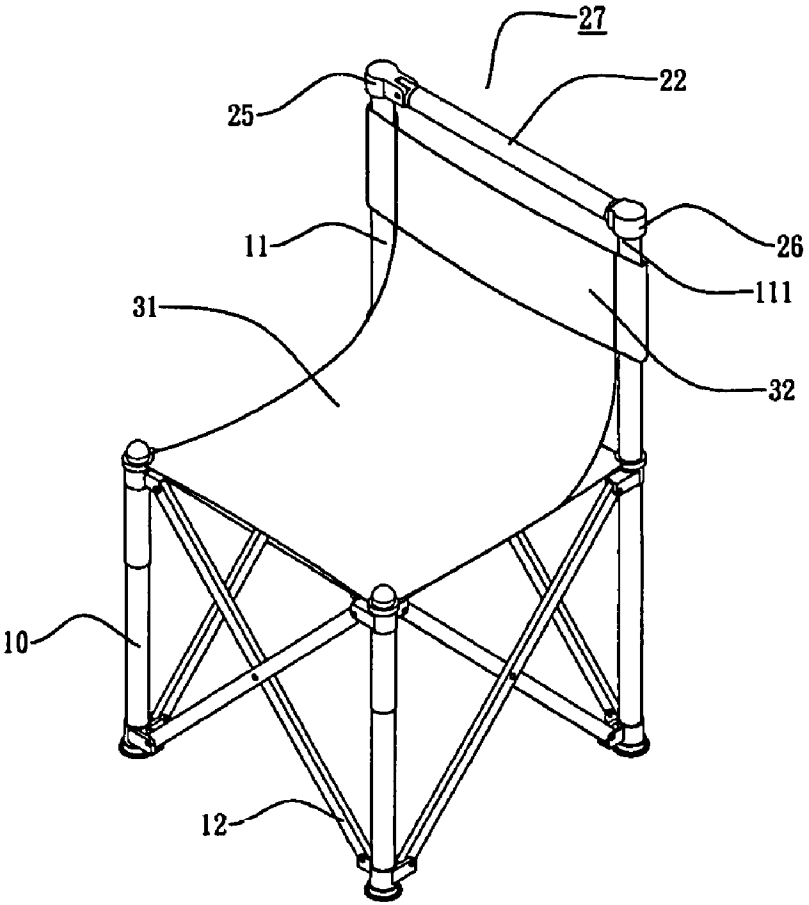

Please refer to FIG. 6, the second arrangement method of the preferred embodiment is performed with installing the double-cap backrest rod (27) as shown in FIG. 5 without installing the armrest rod (13) so as to increase the width and moving angle of the seat.

Please refer to FIG. 6-1, the third arrangement method of the preferred embodiment, a two-way rod cap (24) is secured to the top of the rear leg rod (11). One side of the two-way rod cap (24) is engaged with the armrest rod (13) while another side is engaged with the backrest rod (22) along with the second rod cap (26) so as to form a L shape from the top view for the user being able to lean against the armrest rod (13) or the backrest rod (22).

Figures 1, 7:
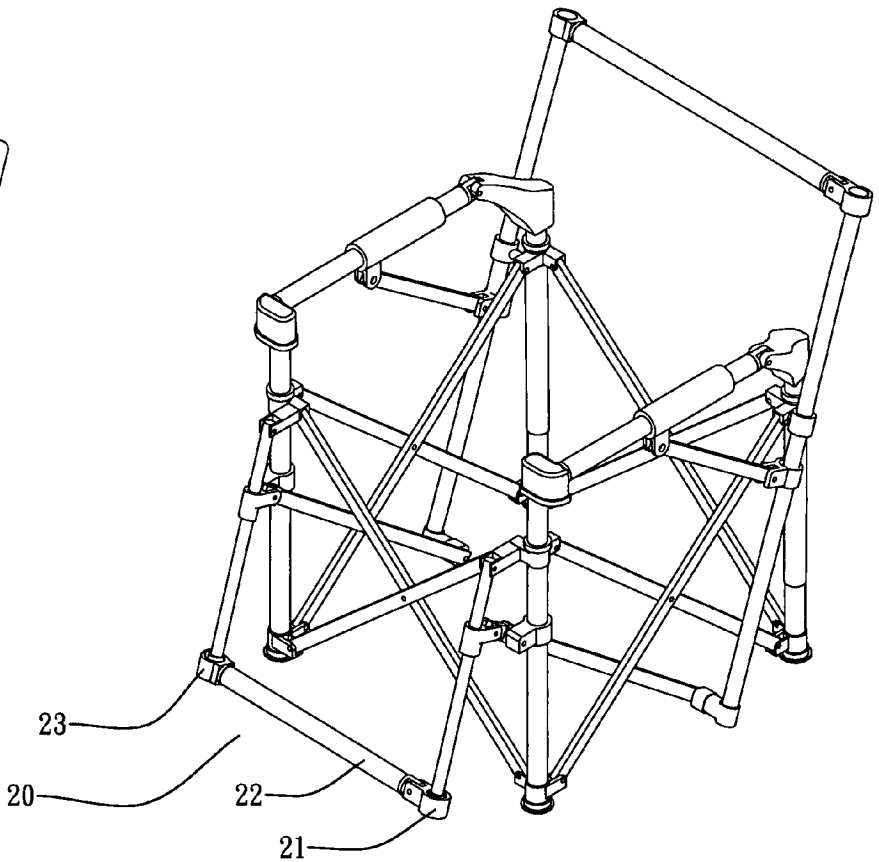
FIG. 7 is a perspective view of the frame structure of the first conventional invention.
Figure 7:
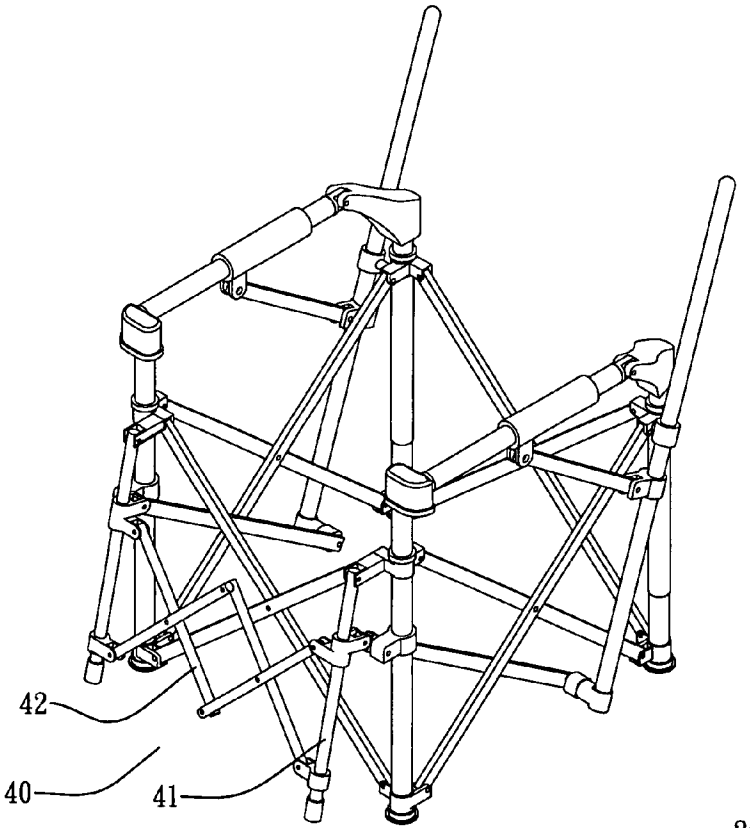
fig. 7 prior art

Please refer to FIG. 7, a perspective view of frame structure of the first conventional invention which refers to a foldable chair with a foot supporting pad, the foot supporting pad (40) includes two rods (41) and a X-shaped collapsible supporting unit (42) able to being folded and extended along with the whole structure. Further, please refer to FIG. 7-1, the fourth arrangement method of the preferred embodiment, the backrest unit (20) can be used to replace the X-shaped collapsible supporting unit (42) by engaging with the end portion of two rods (41) of the foot supporting pad (40) which is shown in FIG. 7.

Figure 8:
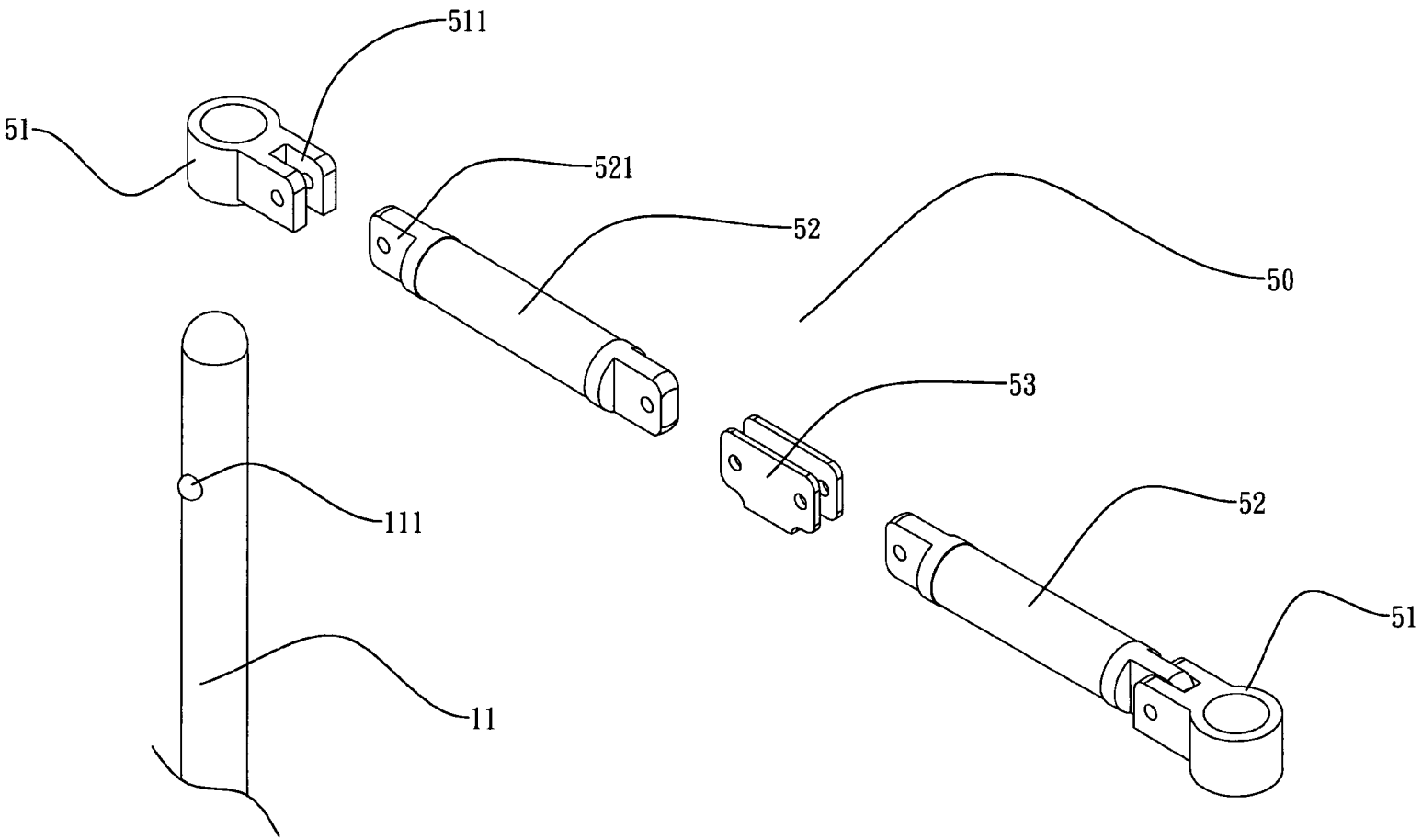
FIG. 8 is an exploded view of the fifth arrangement method of the backrest unit of the foldable chair according to the present invention.
Figures 1, 9:
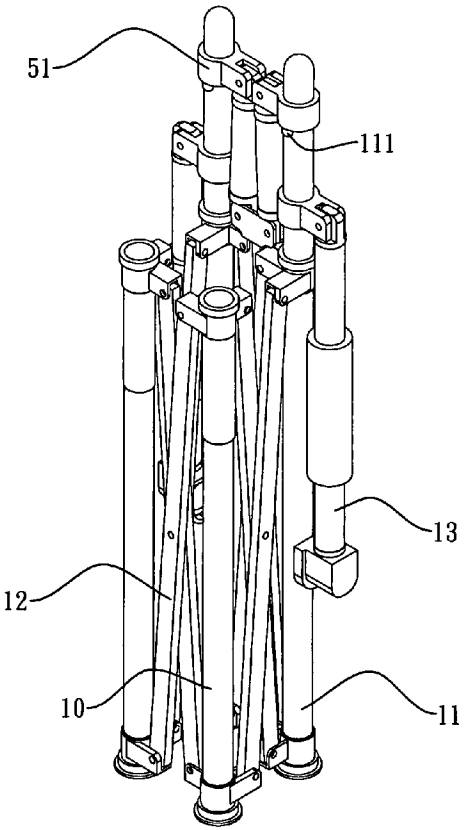
FIG. 9 is a perspective view of the fifth arrangement method of a foldable chair according to the present invention.
Figure 9:
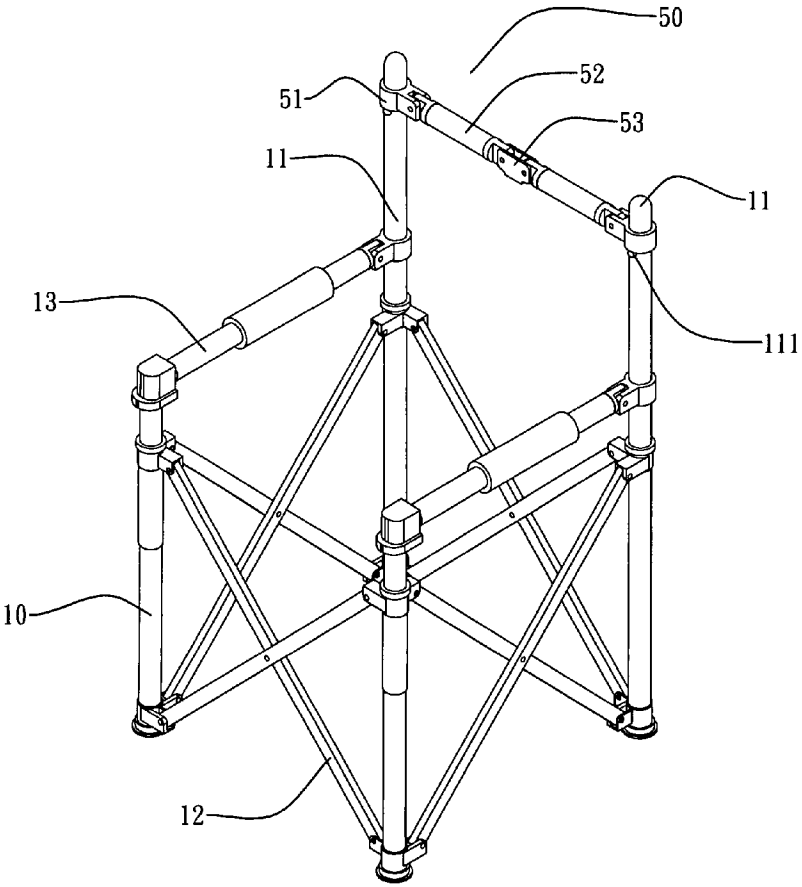
Figures 1, 10:
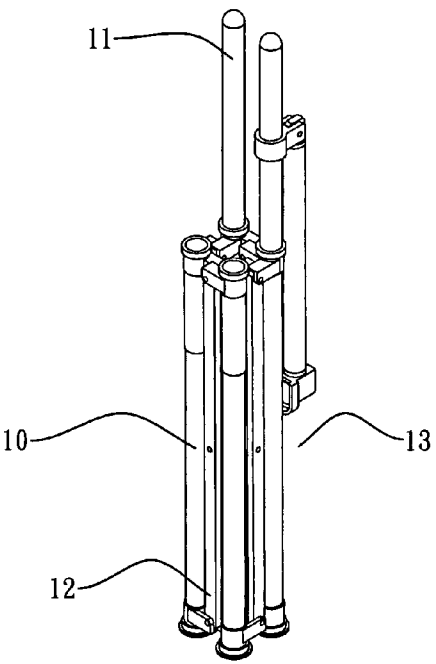
fig. 10-1 prior art
FIG. 10 is a perspective view of the frame structure of a foldable chair of the second conventional invention.
Figure 10:
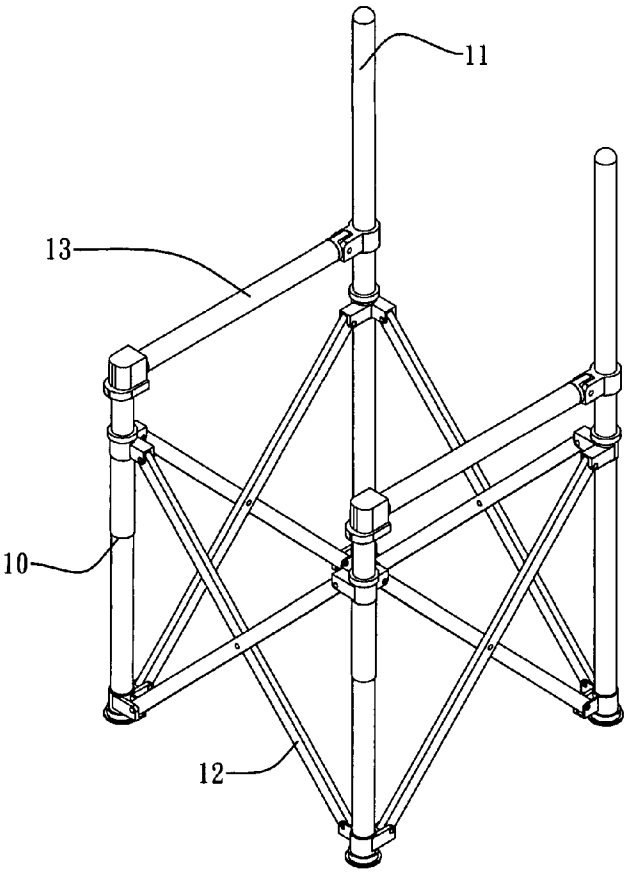
fig. 10 prior art
Figures 1, 11:
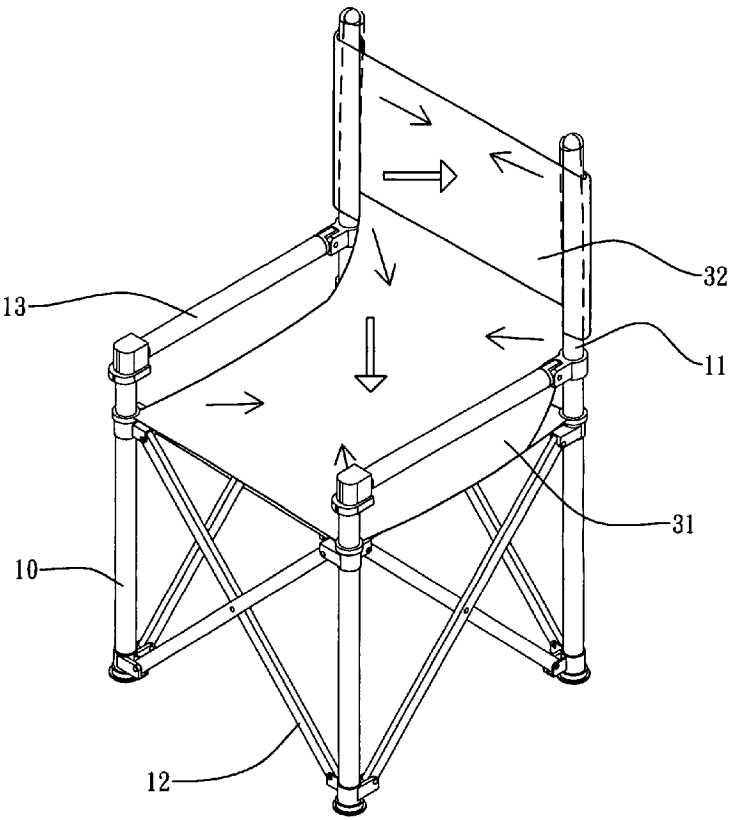
fig. 11-1 prior art
FIG. 11 is a perspective view illustrating the direction of stress of the foldable chair of the second conventional invention.
Figure 11:
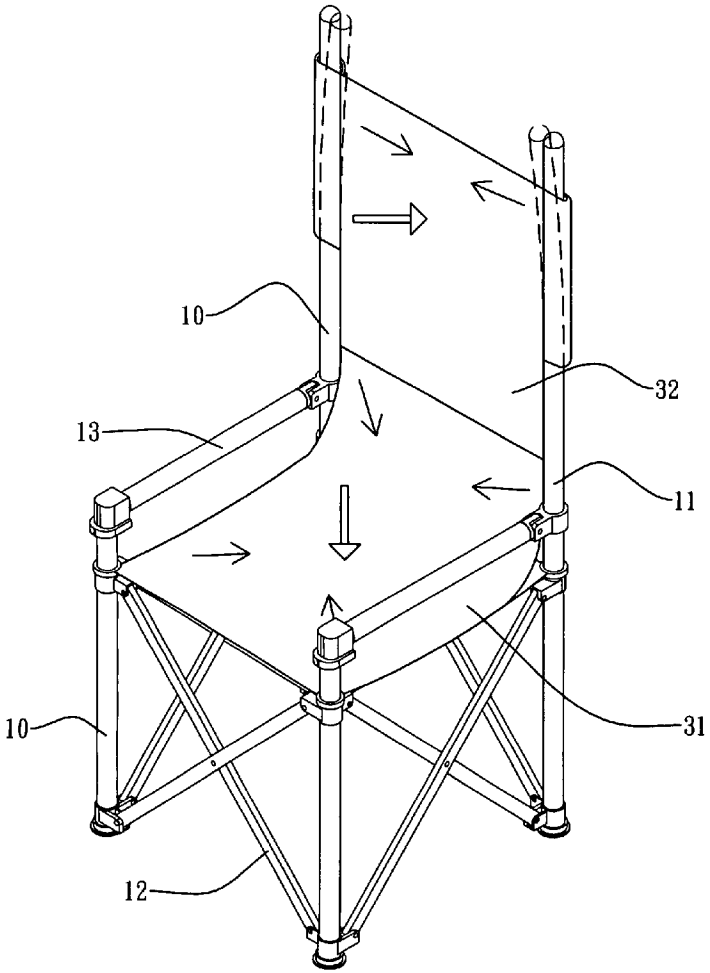
fig. 11 prior art

Please refer to FIGS. 8, 9, and 9-1, the fifth arrangement method of the preferred embodiment, the backrest unit (50) is formed with two sleeves (51), a rod unit (52), and a joint unit (53). The sleeve (51) with a receiving slot (511) being positioned thereon is engaged with the rear leg rod (11). A protrusion plate (521) installed on one side of the rod unit (52) so as to pivotally engage with the receiving slot (511). The joint unit (53) is sandwiched between two parts of the rod unit (52), more particularly, the joint unit (53) is installed on another side of the rod unit (52) and another end of the joint unit (53) is pivotally engaged with the second portion of rod unit (52) while another sleeve (51) being engaged with another rear leg rod (11).

Figures 1, 12:
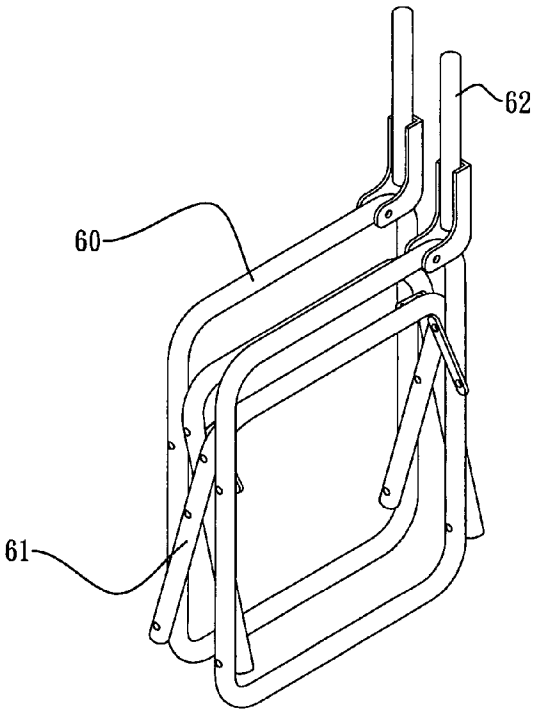
fig. 12-1 prior art
FIG. 12 is a perspective view of the foldable chair in extended position of the third conventional invention.
Figure 12:
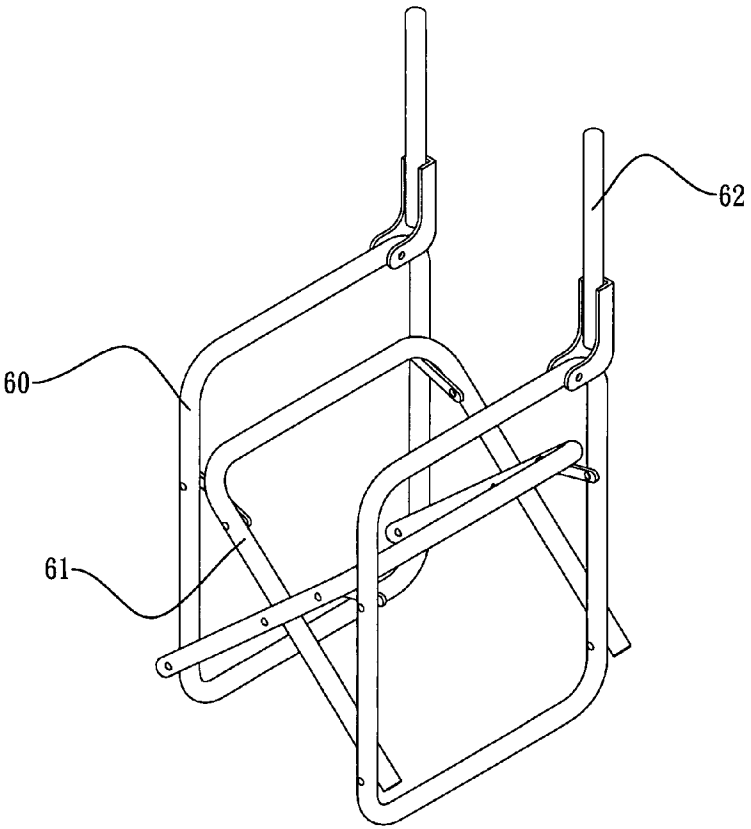
fig. 12 prior art

Please refer to FIGS. 12, 12-1, the perspective view of the extension and folding position of a foldable chair of the third conventional invention, the foldable chair comprises a pair of external supporting frames (60), seat supporting frames (61), and back rods (62). The seat supporting frames (61) are pivotally crisscrossed between the external supporting frames (60) allowing being folded and extended in cross direction. Each back rod (62) is disposed on the external supporting frames (60) respectively.

Figure 13:
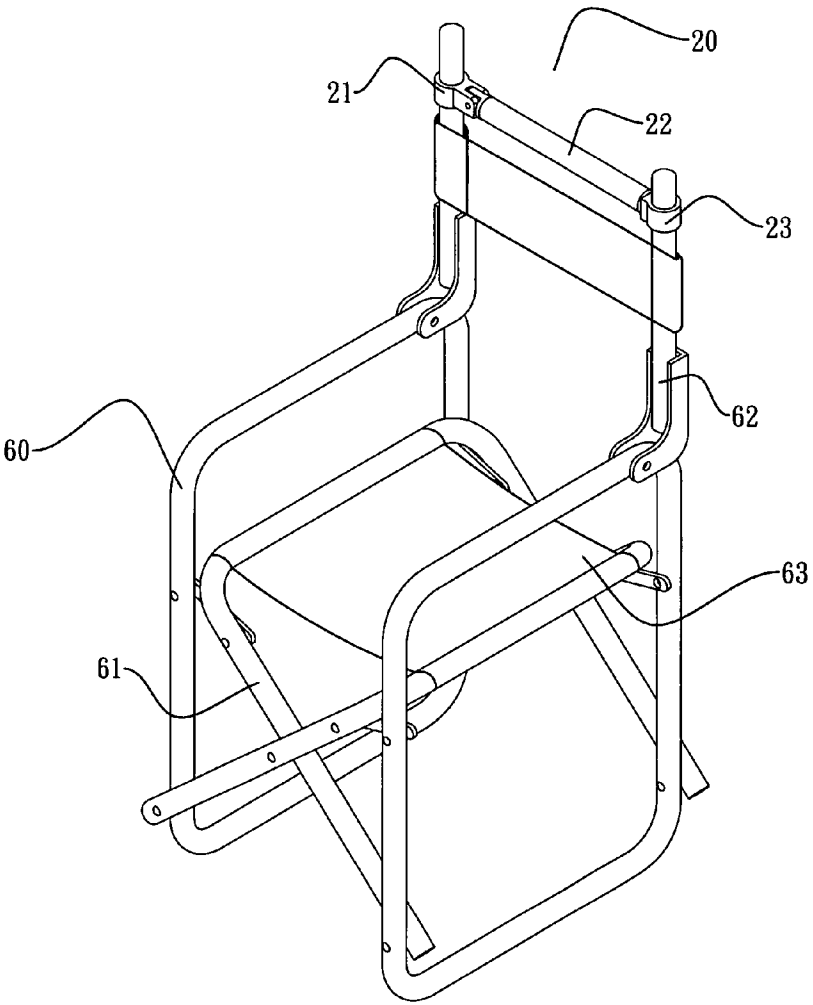
FIG. 13 is the sixth arrangement method of a foldable chair according to the present invention.

Please refer to FIG. 13, the sixth example of a foldable chair in folding position of the present invention, wherein a seat unit (63) is disposed between the seat supporting frames (61) and the backrest unit (20) as shown in FIG. 4 is installed between two back rods (62) to strengthen the cross supporting force of the back rods (62).

I claim:

1. A foldable chair with a backrest unit comprising:

a pair of front leg rods; a pair of rear leg rods, a plurality of interconnected frames, a pair of armrest rods and a seat unit being installed between two rear leg rods so as to enforce supporting strength of said rear leg rods, each of said rear leg rod respectively having a round protrusion being installed thereon, each interconnected frame being installed respectively on said front leg rods and said rear leg rods, said armrest rods being secured between said front and rear leg rods, said backrest unit comprising a first sleeve and a second sleeve and a rod unit, wherein said first sleeve having a receiving slot being engaged through one rear leg rod on one end, said second sleeve being installed on another end of said rod unit and engaged through another rear leg rod to enable said backrest unit to be engaged between said two rear leg rods.

2. A foldable chair with a backrest unit as claimed in claim 1, wherein each first and second sleeve on both ends of said backrest unit can be replaced with a first and second rod caps forming a double-cap backrest unit so as to cover the top end of each rear leg rod.

3. A foldable chair with a backrest unit as claimed in claim 1, wherein said foldable chair is able to be installed with said double-cap backrest unit without said armrest rods so as to increase the width of seat.

4. A foldable chair with a backrest unit as claimed in claim 1, wherein said backrest unit can be replaced with two sleeves, two rod units and a joint unit, wherein each sleeves on each end of replaced backrest unit being installed with a receiving slot is engaged through each rear leg rod, a protrusion plate is positioned on each end of said two rod units to be pivotally secured with said receiving slot, said joint unit is secured with another end of said rod unit to connect said two rod units.

* * * * *